US012612090B2

(12) United States Patent
Kubosawa

(10) Patent No.: US 12,612,090 B2
(45) Date of Patent: Apr. 28, 2026

(54) SIMULATOR DEVICE, SIMULATION METHOD, AND RECORDING MEDIUM

(71) Applicant: NEC Corporation, Tokyo (JP)

(72) Inventor: Shumpei Kubosawa, Tokyo (JP)

(73) Assignee: NEC CORPORATION, Tokyo (JP)

( * ) Notice: Subject to any disclaimer, the term of this patent is extended or adjusted under 35 U.S.C. 154(b) by 32 days.

(21) Appl. No.: 18/287,924

(22) PCT Filed: May 6, 2021

(86) PCT No.: PCT/JP2021/017404

§ 371 (c)(1),
(2) Date: Oct. 23, 2023

(87) PCT Pub. No.: WO2022/234623

PCT Pub. Date: Nov. 10, 2022

(65) Prior Publication Data

US 2024/0190487 A1 Jun. 13, 2024

(51) Int. Cl.
*B61L 27/16* (2022.01)
*B61L 27/60* (2022.01)

(52) U.S. Cl.
CPC ..... *B61L 27/16* (2022.01); *B61L 27/60* (2022.01)

(58) Field of Classification Search
CPC ..... B61L 27/16; B61L 27/60
See application file for complete search history.

(56) References Cited

U.S. PATENT DOCUMENTS

2007/0164726 A1* 7/2007 de Marcken ..... G06Q 50/14 324/127
2022/0073116 A1* 3/2022 Pittman ..... B61L 1/20
2022/0318680 A1* 10/2022 Ayyagari ..... G06Q 10/02
2022/0324675 A1* 10/2022 Zhou-Kangas ..... B66B 1/3453

FOREIGN PATENT DOCUMENTS

JP 2008-062729 A 3/2008
JP 2018-039441 A 3/2018

OTHER PUBLICATIONS

International Search Report for PCT Application No. PCT/JP2021/017404, mailed on Jul. 20, 2021.

* cited by examiner

*Primary Examiner* — Sizo B Vilakazi
(74) *Attorney, Agent, or Firm* — Sughrue Mion, PLLC

(57) ABSTRACT

A simulator device uses, among passenger action ratios linked to selection conditions, a passenger action ratio that is linked to a selection condition matching the type of moving body stopping in a simulation for a traffic system to calculate the number of people alighting from the moving body and/or the number of people boarding the moving body.

7 Claims, 5 Drawing Sheets

SIMULATOR DEVICE, SIMULATION METHOD, AND RECORDING MEDIUM

This application is a National Stage Entry of PCT/JP2021/017404 filed on May 6, 2021, the contents of all of which are incorporated herein by reference, in their entirety.

TECHNICAL FIELD

This invention relates to a simulator device, a simulation method, and a recording medium.

BACKGROUND ART

When simulating train operations, a method has been proposed to determine the behavior of each passenger in order to reflect the fact that different passengers behave differently in the simulation.

For example, Patent Document 1 describes preparing a passenger appearance probability table for each behavioral attribute, such as "earliest train selection type" or "transfer avoidance type," and making a passenger appear for each behavioral attribute according to the probability. In addition, Patent Document 1 describes generating passenger data indicating the behavioral attributes of passengers for each passenger who appears, and having each passenger perform actions such as boarding, transferring, and alighting according to the passenger's behavioral attributes.

PRIOR ART DOCUMENTS

Patent Document

Patent Document 1: Japanese Unexamined Patent Application, First Publication No. 2008-062729

SUMMARY OF THE INVENTION

Problems to be Solved by the Invention

Simulation of the operation of a transportation system, such as a simulation of train operations, should be able to reflect differences in behavior by passengers in the simulation, and should be as light as possible in terms of processing load.

An example of an object of the present invention is to provide a simulator device, a simulation method, and a recording medium that can solve the above-mentioned problems.

Means for Solving the Problem

According to the first example aspect of the present invention, a simulator device is provided with a headcount calculation means which, among passenger action ratios linked to selection conditions, uses a passenger action ratio that is linked to a selection condition matching the type of moving body stopping in a simulation for a traffic system to calculate the number of people alighting from the moving body and/or the number of people boarding the moving body.

According to the second example aspect of the present invention, a simulation method includes using, among passenger action ratios linked to selection conditions, a passenger action ratio that is linked to a selection condition matching the type of moving body stopping in a simulation for a traffic system to calculate the number of people alighting from the moving body and/or the number of people boarding the moving body.

According to the third example aspect of the present invention, a recording medium records a program for causing a computer to use, among passenger action ratios linked to selection conditions, a passenger action ratio that is linked to a selection condition matching the type of moving body stopping in a simulation for a traffic system to calculate the number of people alighting from the moving body and/or the number of people boarding the moving body.

Effect of Invention

The invention can, in a simulation of a transportation system operation, reflect differences in behavior by passengers in the simulation and has a relatively light processing load.

EXAMPLE EMBODIMENT

The following is a description of example embodiments of the present invention, however, these example embodiments are not intended to limit the scope of the invention as claimed. Not all of the combinations of features described in the example embodiments are essential to the solution of the invention.

First Example Embodiment

Figure 1:
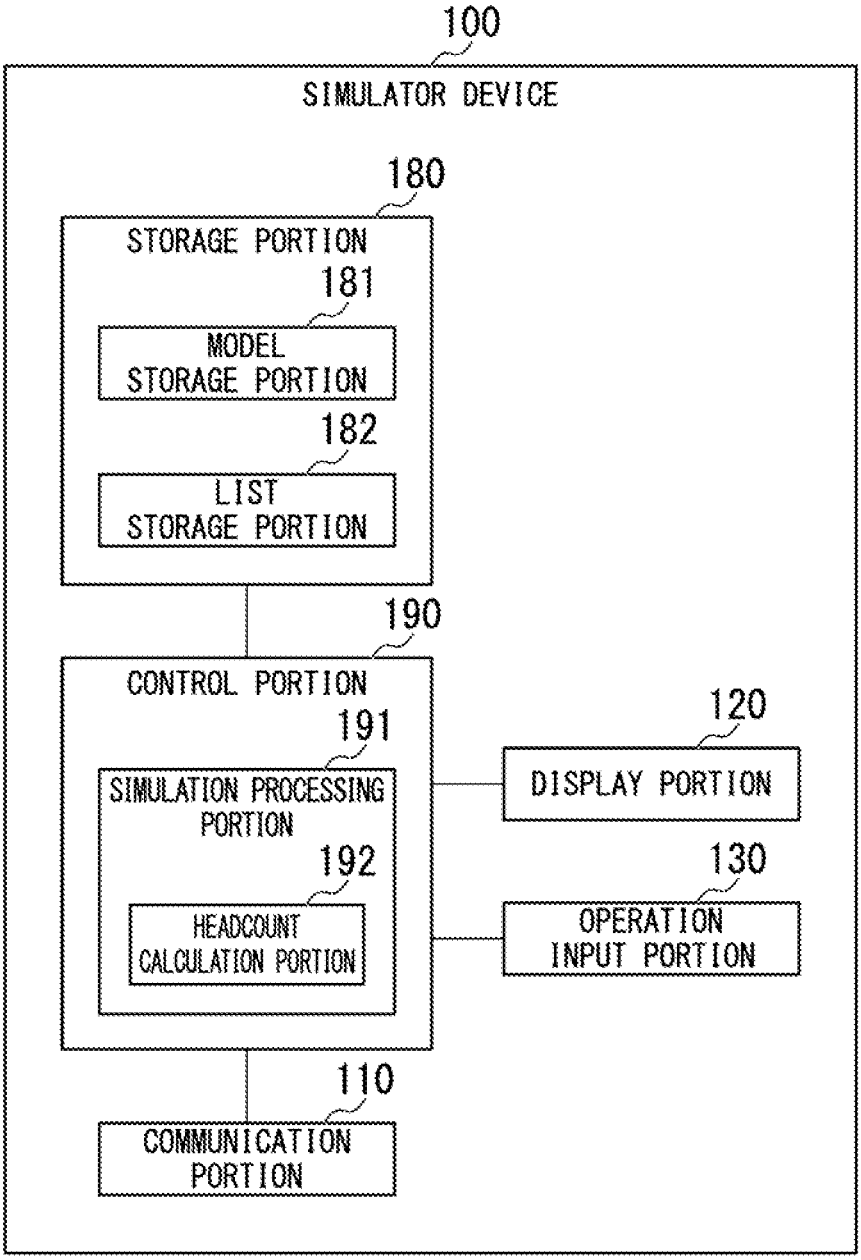
FIG. 1 is a diagram showing an example of the configuration of the simulator device according to the first example embodiment.

FIG. 1 is a diagram showing an example of the configuration of the simulator device according to the first example embodiment. In the configuration shown in FIG. 1, a simulator device 100 is provided with a communication portion 110, a display portion 120, an operation input portion 130, a storage portion 180, and a control portion 190. The storage portion 180 is provided with a model storage portion 181 and a list storage portion 182. The control portion 190 is provided with a simulation processing portion 191 and a headcount calculation portion 192.

The simulator device 100 simulates the operation of a transportation system. The simulator device 100 may be configured using a computer.

In the following, the simulator device 100 will be used to simulate the operation of a train on a railroad. However, the transportation system to be simulated by the simulator device 100 is not limited to a specific transportation system, as it can be a variety of transportation systems where passengers board and disembark and where the pattern of stopping places, such as stations or stops where a vehicle comes to a halt, varies depending on the moving body. A place designated as a place where a moving body stops (comes to a halt) is also called a stop.

Among stops, those where turnstiles are provided and where entry and exit take place are referred to as stations.

The actual railroad is also referred to as a railroad system.

Passenger here is a generic term for both users riding a moving body such as a train, and users who are scheduled to board a moving body, such as users at a station. A passenger who is on a train or other moving body is also referred to as a passenger.

The patterns of stopping places, such as stations or stops where vehicles come to a halt, differing according to the moving vehicles means that different moving bodies have different stop settings, for example, distinctions between limited express, express or regular trains. The type of stop setting for each moving body, such as limited express, express or regular trains, is also referred to as the type of the moving body's priority or the type of the moving body. When the moving body is a train, the type of setting of the station where each train stops, such as limited express, express or normal train, is also referred to as the train's category type or train type.

The communication portion 110 communicates with other devices. For example, the communication portion 110 may communicate with a server device of the railroad system to obtain planning information of the railroad system, such as train operation schedules, and actual information such as actual information of train operations and measured data on the number of passengers entering and exiting each station.

The display portion 120 has a display screen, such as a liquid crystal panel or LED (Light Emitting Diode) panel, for example, and displays various images. For example, the display portion 120 may display the results of a simulation of train operations.

The operation input portion 130 is provided with input devices such as a keyboard and mouse, for example, and receives user operations. For example, the operation input portion 130 may receive a user operation indicating the start of a simulation. The operation input portion 130 may also receive a user operation for setting simulation conditions, such as setting train delays.

The storage portion 180 stores various data. The storage portion 180 is configured using a storage device provided by the simulator device 100.

The model storage portion 181 stores train operation models. A train operation model is a model used to simulate train operations.

The train operation model indicates the arrival and departure times of trains to and from stations. For example, the train operation model may include a route map, and the location of each train in operation may be indicated on the route map. The position of each train on the route map may then be updated at each time step in the simulation.

The list storage portion 182 stores a ratio list. The ratio list contains a number of passenger behavior rules that indicate, in ratio terms, the actions that passengers will take depending on the situation in the simulation.

In each of the passenger action rules, the selection condition is tied to a passenger action ratio. The passenger action ratio indicates the actions taken by passengers as a ratio, such as the ratio of passengers at a station boarding an arriving train. A selection condition indicates the condition for selecting the passenger action ratio that is appropriate for the situation in the simulation. A selection condition, such as, for example, the type of train that stopped at a station, is indicated as a condition that can be judged to be applicable to the situation in the simulation.

The selection condition may include a condition regarding the relationship between the type of train and the passenger's destination station.

The passenger destination station here is the station the passenger wishes to reach. A passenger's destination station may include the final destination station, which is the station where the passenger wants to exit (hand in ticket), and a per-line destination station, which is the station where the passenger wants to connect to another line.

Not limited to train stations, the stop of a moving body that the passenger wants to reach is also called a destination.

For example, the following passenger action rules may be included in the ratio list stored by the list storage portion 182.

(Action Rules for Passengers on Trains Stopped at a Station)

Rule 1: IF stop station is the destination station THEN alight at ratio 1.

Rule 2: IF the next stop of the train being ridden is beyond the destination station THEN alight at ratio 1.

Rule 3: IF train being ridden is a higher-category train AND the next stop of the train being ridden is the destination station or the station before it THEN continue riding at ratio 1.

Rule 4: IF (one following train OR train stopped at platform) is a higher-category train than train being ridden AND the next stop of that higher-category train is at or before the destination station THEN transfer to the higher-category train at a ratio of p_trans2exp, and continue riding train currently being ridden a ratio of 1−p_trans2exp.

(Action Rules for Passengers at a Station when a Train Arrives at that Station)

Rule 5: IF arriving train stops at destination station THEN board arriving train at ratio 1.

Each of rules 1 through 5 is an example of a passenger action rule. In Rule 1, "stop station is the destination station" corresponds to an example of a selection condition, and "alight at ratio 1" corresponds to an example of a passenger action ratio.

In Rule 2, "next stop of the train being ridden is beyond the destination station" corresponds to an example of a selection condition, and "alight at ratio 1" corresponds to an example of a passenger action ratio.

In Rule 3, "train being ridden is a higher-category train AND the next stop of the train being ridden is the destination station or the station before it" corresponds to an example of a selection condition, and "continue riding at ratio 1" corresponds to an example of a passenger action ratio.

In Rule 4, "(one following train OR train stopped at platform) is a higher-category train than train being ridden AND the next stop of that higher-category train is at or before the destination station" corresponds to an example of a selection condition, and "transfer to the higher-category train at a ratio of p_trans2exp, and continue riding train currently being ridden a ratio of 1−p_trans2exp" corresponds to an example of a passenger action ratio.

In Rule 5, "arriving train stops at destination station" corresponds to an example of a selection condition, and "board arriving train at ratio 1" corresponds to an example of a passenger action ratio.

If a passenger returns after going farther than the destination station, it is an illegal boarding, depending on the commuter pass or ticket. For this reason, Rule 2 does not allow a return after going further than the destination station.

In the above action rules, "higher-category" means that the train stops only at some of the stations where the comparable train stops, on the same section of track as the train being compared. For example, express and limited express trains may be classified as higher-category trains relative to regular trains. It is also conceivable that a limited express train could correspond to a higher-category train as opposed to an express train.

The "p_trans2exp" in Rule 4 takes a real value of $0 \leq p_trans2exp \leq 1$. Rule 4 models the existence of a certain number of passengers who do not transfer to a higher-category train because they are seated on the train they are on or for other reasons.

As a prerequisite for setting the ratio, the crew or station staff may provide passengers with information about higher-category trains, so that passengers can ascertain the category type and stops of each train.

The passenger action ratio, such as "p_trans2exp" in Rule 4, may be updated according to the time period on the simulation.

However, the ratio list stored by the list storage portion 182 is not limited to a specific one.

For example, Rule 3 may model the case where a higher-grade train arrives at the starting station of a regular train and some passengers transfer from the higher-grade train to the regular train in order to sit down. Thus, the ratio in Rule 3 may be a value less than 1.

Rule 4 may also be used to model not changing trains if changing to a higher-grade train would result in changing again to the train being ridden before the destination station. For example, Rule 4 may be subdivided into a case where the arrival time at the destination station is accelerated by transferring to a higher-grade train and a case where the arrival time is not accelerated, and the ratio of transferring to a higher-grade train, p_trans2exp, may be set smaller when the arrival time is not accelerated than when it is accelerated.

The ratio in Rule 5 may be less than 1, modeling the fact that some passengers may not board the arriving train, such as when a higher-grade train comes after the arriving train, or when the arriving train is crowded and the passengers wait for the next train.

In the above ratio list, the ratios are expressed as real numbers that are greater than or equal to 0 and less than or equal to 1, but the method of expressing ratios is not limited thereto. For example, the ratios may be expressed as a percentages.

The control portion 190 controls various parts of the simulator device 100 and performs various processes. The functions of the control portion 190 may be performed by the CPU (Central Processing Unit) provided by the simulator device 100, which reads a program from the storage portion 180 and executes it.

The simulation processing portion 191 simulates train operation using a train operation model. The simulation of train operations by the simulation processing portion 191 may include simulation of train operations based on passenger actions, for example, when the total number of passengers boarding and alighting is greater than a predetermined threshold, the train may be delayed in proportion to the number of passengers above the threshold.

The headcount calculation portion 192 calculates, for each passenger action that may affect train operations, the number of passengers performing that action. For example, the headcount calculation portion 192 calculates at least one of the number of people alighting from a train to a station or the number of people boarding a train from a station, using the passenger action ratio associated with the selection condition that matches the type of train stopping at the station, among the passenger action ratios shown in the ratio list.

The headcount calculation portion 192 corresponds to an example of a headcount calculation means.

If the train is stopped at the starting station of the train, the headcount calculation portion 192 calculates only the number of boarding passengers among the number of boarding passengers and the number of alighting passengers. If the train is stopped at the terminal station of the train, the headcount calculation portion 192 calculates only the number of alighting passengers among the number of boarding passengers and the number of alighting passengers.

The headcount calculation portion 192 also calculates the number of people alighting from a train to a station based on the number of train passengers by destination station.

The number of train passengers by destination station may be indicated by the number of passengers per train and per destination station, or it may be indicated as a ratio of the number of passengers on that train.

Alternatively, the number of train passengers by destination station may be shown as a ratio of the number of passengers on the train at each train stop and at each destination station. In this case, the ratio may be updated according to the time period on the simulation.

For example, the headcount calculation portion 192 may calculate the number of alighting passengers for each destination station based on Rule 1 to Rule 4 above, and the total number of alighting passengers for each destination station may be calculated as the number of alighting passengers from that train at that station.

The headcount calculation portion 192 also calculates the number of passengers boarding the train from the station based on the number of passengers at a station by destination station.

The number of passengers at a station by destination station may be indicated by the number of passengers per station and per destination station, or it may be indicated as a ratio of the number of passengers at that station. If the number of passengers at a station by destination station is expressed as a ratio of the number of passengers at that station, the ratio may be updated according to the time of day on the simulation.

For example, the headcount calculation portion 192 may calculate the number of passengers boarding an arriving train at each destination station based on Rule 5 above when a train arrives at a station, and calculate the total number of passengers at each destination station as the number of passengers boarding that train at that station.

Figure 2:
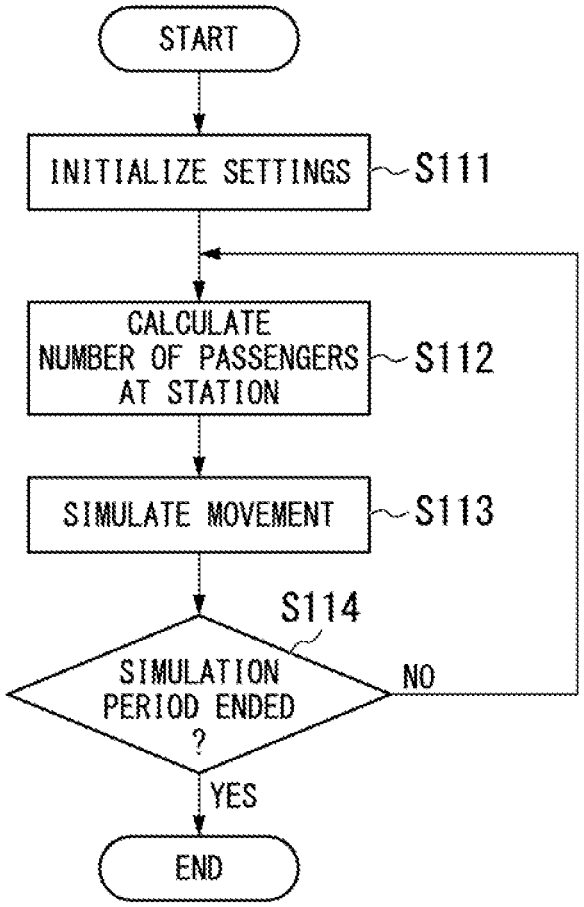
FIG. 2 is a diagram showing an example of the processing procedure in which the simulator device according to the first example embodiment performs a simulation of a transportation system.

FIG. 2 shows an example of a processing procedure in which the simulator device 100 simulates a transportation system.

In the process shown in FIG. 2, the simulation processing portion 191 performs the initial setup of the simulation, including the initial setting of the passenger action ratio (Step S111).

Next, the headcount calculation portion 192 calculates the number of boarding passengers and the number of alighting passengers for trains stopped at the station (Step S112). As described above, the headcount calculation portion 192 calculates the number of boarding passengers and alighting passengers using the ratio list.

Next, the simulation processing portion 191 simulates train movement (Step S113).

Next, the simulation processing portion 191 determines whether the current time on the simulation has passed the predetermined simulation period (Step S114).

If the simulation processing portion 191 determines that the current time on the simulation has not passed the simulation period (Step S114: NO), the process returns to Step S112.

On the other hand, if the simulation processing portion 191 determines that the current time on the simulation has passed the simulation period (Step S114: YES), the simulator device 100 terminates the process in FIG. 2.

As described above, the headcount calculation portion 192 calculates at least one of the number of people alighting from a train to a station or the number of people boarding a train from a station, using the passenger action ratio associated with the selection condition that matches the type of stopped train (train stopped at a station), among the passenger action ratios associated with the selection condition.

This allows the simulator device 100 to reflect differences in actions by passengers in the simulation of train operations and has a relatively light processing load.

One way to reflect differences in passenger actions in a simulation is to set an action pattern for each passenger and simulate the action of each passenger. However, this method is computationally burdensome in that an action must be determined for each passenger. In particular, the larger the number of passengers in this method, the higher the computational load.

In contrast, the simulator device 100 calculates the number of passengers per passenger action, eliminating the need to determine the action for each passenger. According to the simulator device 100, the processing load is relatively light in this respect.

The selection condition for the passenger action ratio includes a condition regarding the relationship between the type of train and the passenger's destination station. The headcount calculation portion 192 calculates at least one of the number of people alighting from the train to the station or the number of people boarding the train from the station based on at least one of the number of train passengers by destination station or the number of passengers at the station by destination station.

According to the simulator device 100, passenger actions can be reflected in train operations, such as simulating train delays caused by a large number of passengers boarding and alighting.

Second Example Embodiment

Figure 3:
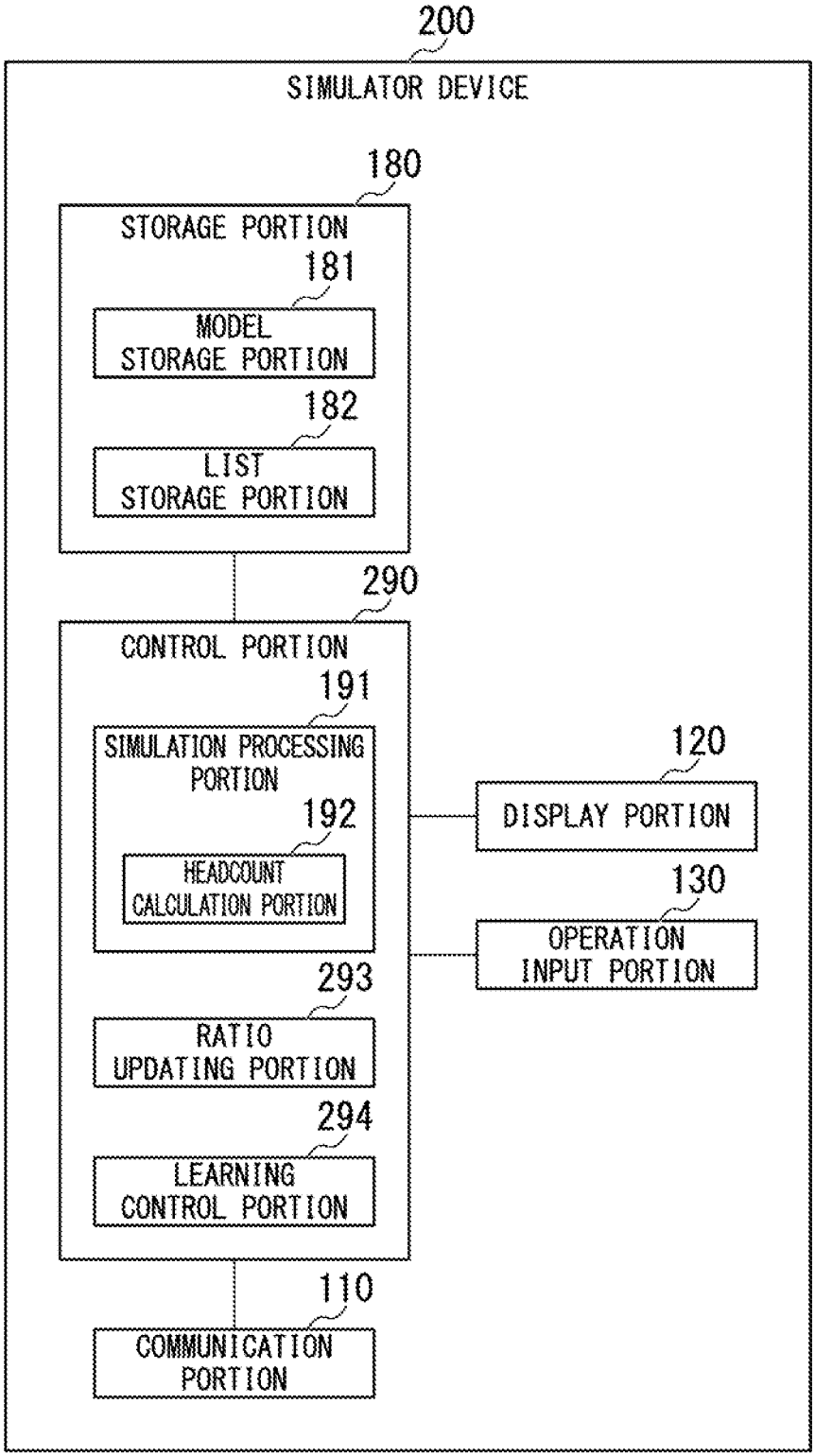
FIG. 3 is a diagram showing an example of the configuration of the simulator device according to the second example embodiment.

FIG. 3 shows an example of the configuration of the simulator device according to the second example embodiment. In the configuration shown in FIG. 3, a simulator device 200 is provided with the communication portion 110, the display portion 120, the operation input portion 130, the storage portion 180, and a control portion 290. The storage portion 180 is provided with the model storage portion 181 and the list storage portion 182. The control portion 290 is provided with the simulation processing portion 191, the headcount calculation portion 192, a ratio updating portion 293, and a learning control portion 294.

Parts of FIG. 3 that have similar configurations corresponding to the parts in FIG. 1 are marked with the same reference numerals (110, 120, 130, 180, 181, 182, 191, 192), and detailed descriptions are omitted here.

The simulator device 200 differs from the simulator device 100 in that the control portion 290 has, in addition to the parts of the control portion 190 in FIG. 1, the ratio updating portion 293 and the learning control portion 294. In other respects, the simulator device 200 is similar to the simulator device 100.

The ratio updating portion 293 updates the passenger action ratio according to the time of day. In addition, the ratio updating portion 293 may update the ratio of the number of train passengers by destination station to the number of passengers on that train. The ratio updating portion 293 may also update the ratio of the number of passengers at a station by destination station to the number of passengers at that station.

The ratio updating portion 293 is an example of a ratio updating means.

The learning control portion 294 controls the learning of the passenger action ratio settings by the ratio updating portion 293. The learning control portion 294 may control the learning of the setting of the passenger action ratio by the ratio updating portion 293 using an evaluation function where the closer the value of the item in the simulation is to the actual value of the item related to the number of passengers, the higher the evaluation.

The learning control portion 294 is an example of a learning control means.

For example, the communication portion 110 may obtain station-by-station historical information on the number of people entering and exiting a station. The learning control portion 294 may then control the learning of the setting of the passenger action ratio by the ratio updating portion 293 with reinforcement learning that uses a reward function that gives a higher evaluation the closer the number of people entering and the number of people exiting in the simulation is to the number of people shown in the historical information.

Reinforcement learning is a type of machine learning. In reinforcement learning, a "measure" which is the action determination basis for determining the "action" of an "agent" in the "environment" based on its observation of the "state" is subject to update by learning. Upon the update of a measure, a "reward" is offered to the agent that represents an evaluation of the environmental impact of the action. In addition to measures, the method of calculating rewards may also be subject to update through learning. As a reward, a so-called "loss" may be offered to the agent, where a smaller value indicates a higher evaluation.

In learning to set the passenger action ratio in the simulator device 200, the ratio updating portion 293 corresponds to an example of an agent. The train operation model and the railroad system that is to be simulated by the train operation model are examples of environments.

The planning information in the railroad system, the actual information in the railroad system, and the information from the simulation result are examples of the states that the ratio updating portion 293, which is the agent, observes.

In this case, the planning information in the railroad system may include train operation planning information, such as train schedules. The performance information in the railroad system may include actual train operation information, such as actual train operation time information, and actual information on passenger actions, such as measured data on the number of passengers entering and exiting each station. The simulation results information may include information on the number of people entering each station in the simulation results. However, the states observed by the ratio updating portion 293 are not limited to the state of a particular item.

The setting and updating of passenger action ratio by the ratio updating portion 293 is an example of an action. The criteria used by the ratio updating portion 293 to calculate the passenger action ratio corresponds to an example of a policy.

The evaluation value obtained by the learning control portion 294 corresponds to an example of a reward. The learning control portion 294 may calculate the so-called loss as a reward, where a smaller value indicates a higher evaluation. For example, the learning control portion 294 may control the learning of the setting of the passenger action ratio by the ratio updating portion 293 so that the reward value becomes smaller, using a reward function that rewards the magnitude of the error between the actual number of passengers entering and leaving each station in the railroad system and the number of passengers entering and leaving each station in the simulation results.

The reinforcement learning used by the simulator device 200 to learn the setting of the passenger action ratio by the ratio updating portion 293 is not limited to a specific type of reinforcement learning, as long as it can handle continuous value parameters. For example, the simulator device 200 may use, but is not limited to, Deep Deterministic Policy Gradients (DDPG) or Proximal Policy Optimization (PPO).

Figure 4:
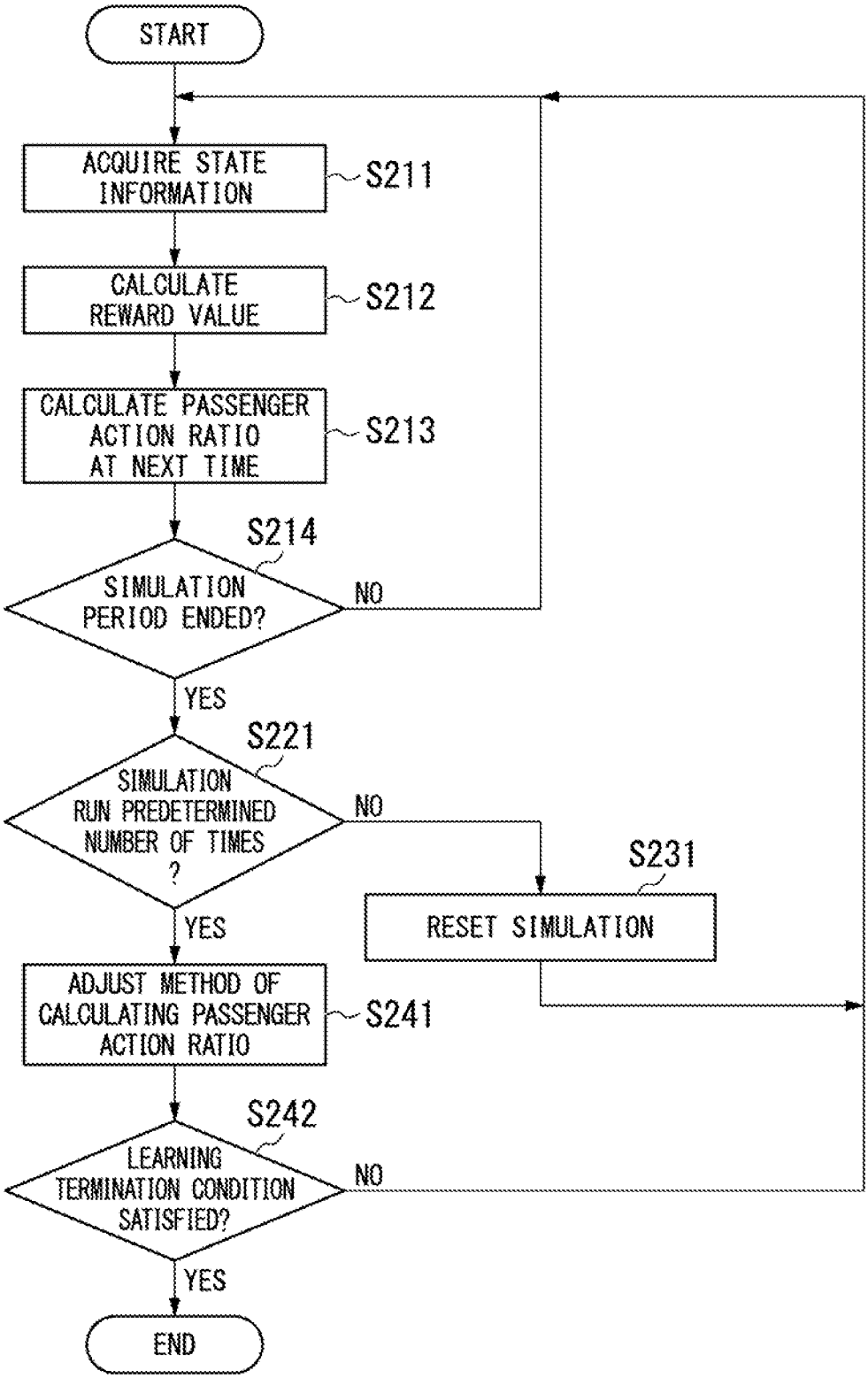
FIG. 4 is a diagram showing an example of the processing procedure in which the simulator device according to the second example embodiment trains the passenger action ratio.

FIG. 4 shows an example of a processing procedure in which the simulator device 200 learns a passenger action ratio.

In the process shown in FIG. 4, the simulator device 200 obtains state information (Step S211). For example, the simulator device 200 obtains simulation result information and stores it in the storage portion 180. At the start of the simulation, the simulator device 200 obtains the initial state information in the simulation instead of the simulation result information.

Next, the learning control portion 294 compares the actual number of people who entered and exited each station with the number of people who entered and exited each station in the simulation results, calculates the reward values for each time and stores them in the storage portion 180 (Step S212). The learning control portion 294 may calculate the reward value every predetermined time range, such as every hour.

Next, the ratio updating portion 293 applies the measure to the state information obtained in Step S211 to calculate the passenger action ratio at the next time (Step S213). The passenger action ratio is treated as a parameter in the ratio list. Therefore, the passenger action ratio is treated as a parameter of the calculation method by which the headcount calculation portion 192 calculates the number of passengers per passenger action.

Next, the simulation processing portion 191 determines whether the current time on the simulation has passed the predetermined simulation period (Step S214).

If the simulation processing portion 191 determines that the current time on the simulation has not passed the simulation period (Step S214: NO), the process returns to Step S211.

On the other hand, if the simulation processing portion 191 determines that the current time on the simulation has passed the simulation period (Step S214: YES), the simulation processing portion 191 determines whether the simulation has been run a predetermined number of times (Step S221).

If the simulation processing portion 191 determines that the number of simulations has not reached the predetermined number (Step S221: NO), the simulator unit 200 stores the simulation result information and reward values in the storage portion 180 and resets the simulator (Step S231). In resetting the simulator, the simulation processing portion 191 restores the train operation model settings to their default settings.

After Step S231, the process returns to Step S211. In this case, the simulator device 200 repeats the simulation for each simulation period until the number of simulations reaches the predetermined number, and accumulates the simulation results and reward values in the storage portion 180.

On the other hand, if the simulation processing portion 191 determines in Step S221 that the number of simulations has reached the predetermined number (Step S221: YES), the learning control portion 294 adjusts the method of calculating the passenger action ratio by the ratio updating portion 293 (Step S241). For example, the learning control portion 294 updates the criteria used by the ratio updating portion 293 to calculate the passenger activity ratio so that the magnitude of the error between the actual number of passengers entering and exiting per station in the rail system and the number of passengers entering and exiting per station in the simulation results is smaller.

As described above, the magnitude of the error between the actual number of passengers entering and exiting per station in the railroad system and the number of passengers entering and exiting per station in the simulation results is an example of the reward value due to losses. The criteria used by the ratio updating portion 293 to calculate the passenger action ratio corresponds to an example of a policy.

Next, the simulator device 200 determines whether the learning termination condition is satisfied (Step S242). The conditions for completion of learning here are not limited to specific conditions. For example, the simulator device 200 may determine whether the number of passengers per action in the simulation is closer than a predetermined condition to the actual value. Alternatively, the simulator device 200 may determine whether the loop of steps S211 to S242 has been repeated a predetermined number of times or more.

If the simulator device 200 determines that the conditions for termination of learning have not been met (Step S242: NO), the process returns to Step S211.

On the other hand, if the simulator determines that the conditions for termination of learning have been met (Step S242: YES), the simulator device 200 terminates the process in FIG. 4.

As described above, the ratio updating portion 293 updates the passenger action ratio according to time.

This allows the simulation of train operations by the simulation processing portion 191 to reflect changes in passenger actions depending on the time of day. According to the simulator device 200, train operations can be simulated with relatively high accuracy in this respect.

The learning control portion 294 controls the learning of the setting of the passenger action ratio by the ratio updating portion 293 using an evaluation function where the closer the value of an item related to the number of passengers in the simulation is to the actual value of the item, the higher the evaluation.

This allows the simulator device 200 to reflect differences in passenger actions in the simulation without the need to set the passenger action ratio in advance.

Here, it is conceivable that the only actual data on passenger flow in a railroad system can be obtained from passenger entry/exit records at stations, such as records of passengers passing through automatic ticket gates. In this case, information such as which train individual passengers boarded is not available from the actual data, and it may be difficult to manually set the passenger activity ratio.

In contrast, the simulator device 200 can set the passenger action ratio even when it is not known from the actual data which trains individual passengers boarded.

The learning control portion 294 uses at least one of the number of passengers entering or exiting a station as the actual value of the item related to the number of passengers.

It is expected that the railroad system will provide actual numbers of people entering and exiting stations. According to the simulator device 200, in this respect, it is expected that the actual number of people entering and exiting stations on the railroad system can be used to learn the setting of the passenger action ratio with relatively high accuracy.

Third Example Embodiment

Figure 5:
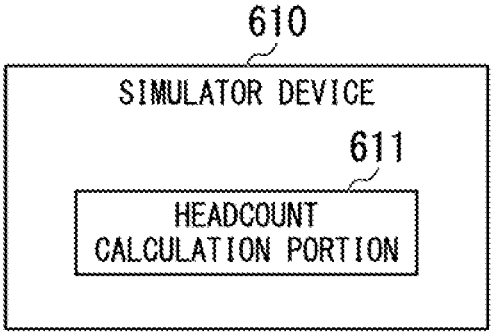
FIG. 5 is a diagram showing an example of the configuration of the simulator device according to the third example embodiment.

FIG. 5 shows an example of the configuration of the simulator device according to the third example embodiment. In the configuration shown in FIG. 5, a simulator device 610 is provided with a headcount calculation portion 611.

In such a configuration, the headcount calculation portion 611 calculates at least one of the number of passengers alighting from a moving body to a station or the number of passengers boarding from a station to the moving body, using, among passenger action ratios association with a selection condition, the passenger action ratio associated with the selection condition that matches the type of moving body that stops at the station in the transportation system simulation.

The headcount calculation portion 611 corresponds to an example of a headcount calculation means.

The simulator device 610 allows simulations of transportation system operations to reflect differences in actions by passengers in the simulation, and has a relatively light processing load.

One way to reflect differences in passenger actions in a simulation is to set an action pattern for each passenger and simulate the action of each passenger. However, this method is computationally burdensome in that an action must be determined for each passenger. In particular, the larger the number of passengers in this method, the higher the computational load.

In contrast, the simulator device 610 calculates the number of passengers per passenger action, eliminating the need to determine the action for each passenger. According to the simulator device 610, the processing load is relatively light in this respect.

The headcount calculation portion 611 can be realized, for example, using functions such as the headcount calculation portion 192 shown in FIG. 1.

Fourth Example Embodiment

Figure 6:
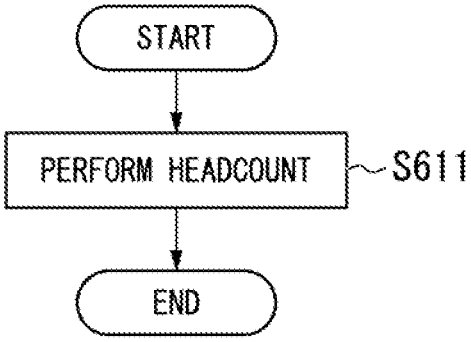
FIG. 6 is a diagram showing an example of the processing procedure in the simulation method according to the fourth example embodiment.

FIG. 6 is a diagram showing an example of the processing procedure in the simulation method according to the fourth example embodiment. The method shown in FIG. 6 includes performing a headcount calculation (Step S611).

Performing a headcount (Step S611) involves calculating at least one of the number of passengers alighting from a moving body to a station or the number of passengers boarding from a station to the moving body, using, among passenger action ratios association with a selection condition, the passenger action ratio associated with the selection condition that matches the type of moving body that stops at the station in the transportation system simulation.

The simulation method shown in FIG. 6 allows simulations of transportation system operations to reflect differences in actions by passengers in the simulation, and has a relatively light processing load.

One way to reflect differences in passenger actions in a simulation is to set an action pattern for each passenger and simulate the action of each passenger. However, this method is computationally burdensome in that an action must be determined for each passenger. In particular, the larger the number of passengers in this method, the higher the computational load.

In contrast, the simulation method shown in FIG. 6 calculates the number of passengers per passenger action, eliminating the need to determine the action for each passenger. According to the simulation method shown in FIG. 6, the processing load is relatively light in this respect.

Figure 7:
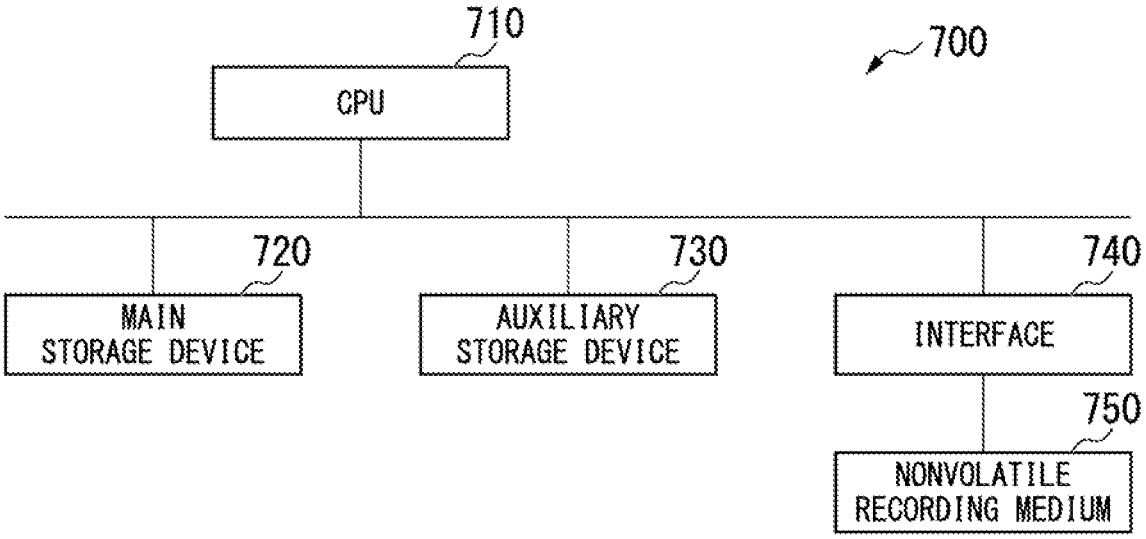
FIG. 7 is a schematic block diagram showing the configuration of a computer according to at least one example embodiment.

FIG. 7 is a schematic block diagram showing the configuration of a computer according to at least one example embodiment.

In the configuration shown in FIG. 7, a computer 700 is provided with a CPU 710, a main storage device 720, an auxiliary storage device 730, an interface 740, and a nonvolatile recording medium 750.

Any one or more of the above simulator devices 100, 200, and 610, or portions thereof, may be implemented in the computer 700. In that case, the operations of each of the above-mentioned processing portions are stored in the auxiliary storage device 730 in the form of a program. The CPU 710 reads the program from the auxiliary storage device 730, deploys the program to the main storage device 720, and executes the above processing according to the program. The CPU 710 also reserves a storage area in the main storage device 720 corresponding to each of the above-mentioned storage portions according to the program. Communication between each device and other devices is performed by the interface 740, which has a communication function and communicates according to the control of the CPU 710. The interface 740 also has a port for the nonvolatile recording medium 750 and reads information from and writes information to the nonvolatile recording medium 750.

When the simulator device 100 is implemented in the computer 700, the operations of the control portion 190 and the various portions thereof are stored in the auxiliary storage device 730 in the form of a program. The CPU 710 reads the program from the auxiliary storage device 730, deploys the program to the main storage device 720, and executes the above processing according to the program.

The CPU 710 also reserves a storage area in the main storage device 720 corresponding to the storage portion 180 and each portion thereof according to the program. The communication performed by the communication portion 110 is executed by the interface 740, which has a communication function and communicates according to the control of the CPU 710. The display of images by the display portion 120 is performed by the interface 740, which is equipped with a display portion and displays images according to the control of the CPU 710. Reception of a user operation by the operation input portion 130 is performed by the interface 740, which is equipped with an input device to receive user operations.

When the simulator device 200 is implemented in the computer 700, the operations of the control portion 290 and the various portions thereof are stored in the auxiliary storage device 730 in the form of a program. The CPU 710 reads the program from the auxiliary storage device 730, deploys the program to the main storage device 720, and executes the above processing according to the program.

The CPU 710 also reserves a storage area in the main storage device 720 corresponding to the storage portion 180 and each portion thereof according to the program. The communication performed by the communication portion 110 is executed by the interface 740, which has a communication function and communicates according to the control of the CPU 710. The display of images by the display portion 120 is performed by the interface 740, which is equipped with a display device and displays images according to the control of the CPU 710. Reception of a user operation by the operation input portion 130 is performed by the interface 740, which is equipped with an input device to receive user operations.

When the simulator device 610 is implemented in the computer 700, the operations of the headcount calculation portion 611 are stored in the auxiliary storage device 730 in the form of a program. The CPU 710 reads the program from the auxiliary storage device 730, deploys the program to the main storage device 720, and executes the above processing according to the program.

Communication between the simulator device 610 and other devices is performed by the interface 740, which has a communication function and operates according to the control of the CPU 710.

Interactions between the simulator device 610 and the user are performed by the interface 740, which has an input device and an output device, presenting information to the user with the output device and receiving user operations with the input device according to the control of the CPU 710.

Any one or more of the above programs may be recorded in the nonvolatile recording medium 750. In this case, the interface 740 may read the program from the nonvolatile recording medium 750. The CPU 710 may then directly execute the program read by the interface 740, or may once store the program in the main storage device 720 or the auxiliary storage device 730 and then execute it.

A program for executing all or part of the processing performed by simulator devices 100, 200, and 610 may be recorded on a computer-readable recording medium, and the program recorded on this recording medium may be read into a computer system and executed to perform the processing of each portion. The term "computer system" here shall include an operating system and hardware such as peripherals.

In addition, "computer-readable recording medium" means a portable medium such as a flexible disk, magneto-optical disk, ROM (Read Only Memory), CD-ROM (Compact Disc Read Only Memory), or other storage device such as a hard disk built into a computer system. The above program may be used to realize some of the aforementioned functions, and may also be used to realize the aforementioned functions in combination with programs already recorded in the computer system.

While the above example embodiments of this invention have been described in detail with reference to the drawings, specific configurations are not limited to these example embodiments, but also include designs and the like to the extent that they do not depart from the gist of this invention.

INDUSTRIAL APPLICABILITY

The present invention may be applied to a simulator device, a simulation method, and a recording medium.

DESCRIPTION OF REFERENCE SIGNS

100, 200, 610 Simulator device
110 Communication portion
120 Display portion
130 Operation input portion
180 Storage portion
181 Model storage portion
182 List storage portion
190, 290 Control portion
191 Simulation processing portion
192, 611 Headcount calculation portion
293 Ratio updating portion
294 Learning control portion

What is claimed is:

1. A simulator device for planning moving body operation schedules in a transportation system, the simulator device comprising:

at least one memory configured to store instructions; and at least one processor configured to execute the instructions to:

store a passenger action ratio indicating actions taken by a passenger as a ratio, wherein the passenger action ratio is applied based on a plurality of passenger action rules according to a relationship between an action attribute of the passenger, a type of the moving body, a crowding condition in the moving body, and a destination of the passenger;

among passenger action ratios linked to selection conditions, calculate, based on the passenger action ratio and a prediction model trained by machine learning, at least one of a number of people alighting from the moving body to a station or a number of people boarding the moving body by using the passenger action ratio that is linked to a selection condition matching the type of moving body stopping in a simulation for the transportation system; and simulate, based on the calculated number of people alighting from the moving body, the number of people boarding the moving body and a moving body operation simulation model configured to simulate moving body operations, a delay in the train operation by adjusting at least one of a departure time from the station or an arrival time at the station to obtain planning information for scheduling moving body operations.

2. The simulator device according to claim 1, wherein the selection condition includes a condition regarding the relationship between the type of moving body and the passenger's destination, and the at least one processor is configured to execute the instructions to calculate at least one of the number of people alighting from the moving body and the number of people boarding the moving body based on at least one of the number of passengers of the moving body by destination and the number of passengers at a stop of the moving body by destination.

3. The simulator device according to claim 1, wherein the at least one processor is further configured to execute the instructions to update the passenger action ratio according to time.

4. The simulator device according to claim 3, wherein the at least one processor is further configured to execute the instructions to control the learning of the setting of the passenger action ratio using an evaluation function in which the closer a value of an item related to the number of passengers in a simulation is to an actual value of the item, the higher the evaluation.

5. The simulator device according to claim 4, wherein the at least one processor is configured to execute the instructions to use at least one of the number of people entering a stop and the number of people exiting a stop as the actual value of the item related to the number of passengers.

6. A simulation method for planning moving body operation schedules in a transportation system, the simulation method comprising:

storing a passenger action ratio indicating actions taken by a passenger as a ratio, wherein the passenger action ratio is applied based on a plurality of passenger action rules according to a relationship between an action attribute of the passenger, a type of the moving body, a crowding condition in the moving body, and a destination of the passenger;

among passenger action ratios linked to selection conditions, calculating, based on the passenger action ratio and a prediction model trained by machine learning, at least one of a number of people alighting from a moving body to a station or a number of people boarding the moving body by using the passenger action ratio that is linked to a selection condition matching the type of moving body stopping in a simulation for the transportation system; and simulating, based on the calculated number of people alighting from the moving body, the number of people boarding the moving body and a moving body operation simulation model configured to simulate moving body operations, a delay in the train operation by adjusting at least one of a departure time from the station or an arrival time at the station to obtain planning information for scheduling moving body operations.

7. A non-transitory recording medium that stores a program for causing a computer to execute a simulation method for planning moving body operation schedules in a transportation system, the simulation method comprising:

storing a passenger action ratio indicating actions taken by a passenger as a ratio, wherein the passenger action ratio is applied based on a plurality of passenger action rules according to a relationship between an action attribute of the passenger, a type of the moving body, a crowding condition in the moving body, and a destination of the passenger;

among passenger action ratios linked to selection conditions, calculating, based on the passenger action ratio and a prediction model trained by machine learning at least one of a number of people alighting from a moving body or a number of people boarding the moving body by using the passenger action ratio that is linked to a selection condition matching the type of moving body stopping in a simulation for the transportation system; and simulate, based on the calculated number of people alighting from the moving body, the number of people boarding the moving body and a moving body operation simulation model configured to simulate moving body operations, a delay in the train operation by adjusting at least one of a departure time from the station or an arrival time at the station to obtain planning information for scheduling moving body operations.

* * * * *